US010189553B2

(12) United States Patent
Portier et al.

(10) Patent No.: US 10,189,553 B2
(45) Date of Patent: Jan. 29, 2019

(54) WATER INTAKE SYSTEM AND FLOATING VESSEL EQUIPPED WITH SUCH A SYSTEM

(71) Applicant: SBM SCHIEDAM B.V., Schiedam (NL)

(72) Inventors: Douwe Barend Portier, Breda (NL); Joost Wouter Van Sonsbeek, Utrecht (NL)

(73) Assignee: SINGLE BUOY MOORINGS INC., Marly (CH)

( * ) Notice: Subject to any disclaimer, the term of this patent is extended or adjusted under 35 U.S.C. 154(b) by 0 days.

(21) Appl. No.: 15/552,881

(22) PCT Filed: Feb. 22, 2016

(86) PCT No.: PCT/NL2016/050125

§ 371 (c)(1),
(2) Date: Aug. 23, 2017

(87) PCT Pub. No.: WO2016/144158

PCT Pub. Date: Sep. 15, 2016

(65) Prior Publication Data

US 2018/0029684 A1 Feb. 1, 2018

(30) Foreign Application Priority Data

Feb. 23, 2015 (EP) ..... 15156123

(51) Int. Cl.

| | |
|---|---|
| ***B63J 2/00*** | (2006.01) |
| ***B63B 21/50*** | (2006.01) |
| ***B63B 22/02*** | (2006.01) |
| ***B63B 35/44*** | (2006.01) |
| ***E21B 17/01*** | (2006.01) |
| ***E21B 19/00*** | (2006.01) |
| *E21B 43/01* | (2006.01) |

(52) U.S. Cl.
CPC ..... *B63J 2/00* (2013.01); *B63B 21/507* (2013.01); *B63B 22/02* (2013.01); *B63B 35/44* (2013.01);
(Continued)

(58) Field of Classification Search
CPC ..... B63J 2/00; B63J 2002/005; B63B 35/44; B63B 2035/448; B63B 2035/4486;
(Continued)

(56) References Cited

U.S. PATENT DOCUMENTS 4,298,295 A * 11/1981 Bozzo ..... F03G 7/05 405/52
4,444,250 A 4/1984 Keithahn et al.
(Continued)

FOREIGN PATENT DOCUMENTS

AU 2011 230 933 A1 9/2012
WO 2002102653 A1 12/2002
(Continued)

OTHER PUBLICATIONS

International Search Report, dated Jun. 3, 2016, from corresponding PCT/NL2016/050125 application.

*Primary Examiner* — Ajay Vasudeva
(74) *Attorney, Agent, or Firm* — Young & Thompson

(57) ABSTRACT

Disclosed is a water intake system for a floating vessel in a body of water, which includes within the hull of the vessel an intake compartment for taking in water from the body of water and a distribution compartment for distributing and supplying the water to one or more consumer units within the floating vessel. The intake compartment is arranged below a lowest operational draught of the vessel and has an inlet in a bottom region of the intake compartment. The intake compartment is coupled by a conduit to the distribution compartment for allowing water to flow into the distribution compartment. The water intake system further includes a water lift hose that is connected to the inlet and is extendible below the hull of the vessel.

15 Claims, 4 Drawing Sheets

(52) U.S. Cl.
CPC ..... *E21B 17/01* (2013.01); *E21B 19/004* (2013.01); *B63B 2035/448* (2013.01); *B63J 2002/005* (2013.01); *E21B 43/01* (2013.01)

(58) Field of Classification Search
CPC ... B63B 13/00; B63B 2013/005; B63B 13/02; B63B 17/00; E21B 17/01; E21B 19/004; E21B 43/01
See application file for complete search history.

(56) References Cited

U.S. PATENT DOCUMENTS 4,497,342 A * 2/1985 Wenzel ..... F03G 7/05 137/565.17
5,697,732 A * 12/1997 Sigmundstad ..... B63B 22/026 141/279
6,845,727 B2 * 1/2005 Eide ..... B63B 13/02 166/355
7,311,055 B2 * 12/2007 Peereboom ..... B63B 21/507 114/230.12
2011/0173979 A1 * 7/2011 Krull ..... F03G 7/05 60/641.7

FOREIGN PATENT DOCUMENTS

WO 03/006786 A1 1/2003
WO 03/104604 A1 12/2003
WO 2010010500 A1 1/2010
WO WO-2010010500 A1 * 1/2010 ..... F16L 1/15
WO 2011/118228 A1 9/2011
WO WO-2011118228 A1 * 9/2011 ..... B63B 13/02
WO WO-2016038081 A1 * 3/2016 ..... B63B 13/00

* cited by examiner

WATER INTAKE SYSTEM AND FLOATING VESSEL EQUIPPED WITH SUCH A SYSTEM

FIELD OF THE INVENTION

The present invention relates to a water intake system. Additionally, the invention relates to a floating vessel equipped with such a water intake system.

BACKGROUND

In offshore technologies, use is made of floating vessels for storage and/or production of hydro-carbon fluids, from undersea gas or oil fields. Such floating vessels comprise floating storage and offloading (FSO) and floating production, storage and offloading (FPSO) vessels.

Such a floating vessel may be secured at its operational position, by a structure of a number of mooring lines (or mooring legs), which connect to anchoring facilities at or in the seabed, geographically distributed i.e., spread around the position.

Alternatively, the floating vessel can be secured at its operational position by a disconnectable turret mooring system comprising a mooring buoy and a turret mooring structure. The mooring buoy is anchored to the seabed with anchoring legs. The turret mooring structure, provided on the floating vessel, has a receptacle for receiving the buoy member and one or more buoy locking devices for locking the buoy member in the receptacle.

The turret mooring structure may be an internal turret mooring structure or an external turret mooring structure. An internal turret mooring structure is provided inside the hull of the vessel, in a so-called moonpool of the vessel. The receptacle is formed as an opening at or near the bottom of the vessel, facing downwards. An external turret mooring structure is provided outside the hull of the vessel. The external turret is fixed with suitable connection members to the bow or stern of the vessel.

When the floating vessel is in operation, processing equipment on the floating vessel produces hydro-carbon fluids from sources as undersea gas or oil fields. During this operation the processing equipment uses seawater for auxiliary purposes such as cooling.

From the prior art seawater intake systems are known. For example WO2010010500 discloses a seawater suction system that comprises first and second conduits that can be linked together to form a hose. The first and second conduits are each formed from different materials.

WO2002102653 discloses a vessel riser system assembly. The assembly is made up generally of a sea chest component, a track in communication with the sea chest and the riser attachable to the sea chest. The sea chest is typically pre-fabricated and attached to the FPSO in dry dock prior to offshore operations. In particular, the sea chest is attached to the hull of the FPSO at a seawater intake grid. The track is made up of parallel first and second rails respectively which extend upwards from the sea chest, either side of the sea chest, at the sea water intake grid. The track is attached to the side of the FPSO between the FPSO deck top side and the seawater intake grid.

Both disclosures relate to water intake systems that are operational during the time that the FPSO or FLNG vessel is at fixed position in production mode.

It is an object of the present invention to overcome or mitigate the disadvantages from the prior art.

SUMMARY OF THE INVENTION

The object is achieved by a water intake system for a floating vessel in a body of water, the water intake system comprising within the hull of the vessel:

an intake compartment for taking in water from the body of water and a distribution compartment for distributing and supplying the water to one or more consumer units within the floating vessel;

the intake compartment being arranged below a lowest operational draught of the vessel and having an inlet in a bottom region of the intake compartment, the intake compartment being in fluid communication with the distribution compartment for allowing water to flow into the distribution compartment;

the water intake system further comprising a water lift hose that is connected to the inlet and is extendible below the hull of the vessel.

The seawater intake system according to the invention is arranged for floating production units such as FLNGs & FPSOs. Seawater is received via a centralized water intake compartment that is located below the FPSO lowest draught. Because of the location of the compartment, flow is gravity induced and seawater flows in through this compartment.

The sea water intake system enables the FPSO/FLNG to have a centralized seawater intake from various water depths, notably seawater intake from a significant water depth when the FPSO is operational above its field ("in production") and surface seawater intake when sailing. Changing modes of operation can be achieved without diver intervention.

The water intake system has an advantage over the commonly used sea chest solutions for seawater intake. Sea chests are always open for surface water and thus susceptible to marine growth and therefore less suitable for use on an FPSO that will be moored on location for many years. The invention provides to have all seawater-intake through deep sea water lift hoses when the FPSO is producing above its field. The inlet point is well below the seawater surface thus making it less susceptible to marine growth. Deep sea water intake also contributes to better topsides performance because of the lower temperature of the water from that deeper location.

This dual mode of operation is in particular relevant for FPSOs with disconnectable mooring systems.

In case of geographic locations with severe (sometimes cyclonic) weather conditions or in case of ice floe, it can become necessary to move the FPSO to a quieter/safer location by disconnecting the FPSO from the mooring buoy. If however the requirement exists to have seawater intake from large depth (related to temperature of the seawater and/or marine growth) this immediately poses the problem that apart from the mooring system disconnection activities, the seawater lift hose needs also to be removed as it is not envisaged to sail with (possibly long) hoses attached to the hull. Diver assisted removal of the hoses is not advisable since the very reason to abandon is the weather conditions that are getting worse. According to the invention, a so called dual mode of operation is envisaged, as described above. The change-over between operational modes can be realized well within the disconnection time of the mooring system.

According to an aspect there is provided a water intake system as described above, wherein the inlet is arranged in a substantially horizontal plane in the hull and the water lift hose extends vertically from the hull.

In this manner a connection is provided that in its rest position is without torque.

According to an aspect there is provided a water intake system as described above, wherein the water lift hose is suspended from a higher level of the vessel above the intake compartment through an internal opening in a top region of the intake compartment.

From the higher level of the vessel, which could be the top deck, the water lift hose of the water intake system can be (de)installed without diver intervention. Thereto, the system includes a mechanical handling system and a hose storage rack on said higher level.

According to an aspect there is provided a water intake system as described above, wherein the water lift hose is guided through a caisson between the higher level of the vessel and the internal opening of the intake compartment. The caisson provides a path for the water lift hose between the higher level and the intake compartment.

According to an aspect there is provided a water intake system as described above, wherein the water lift hose comprises an open pipe section located inbetween the inlet and the internal opening of the intake compartment and that is configured to mount at the inlet.

The open pipe section thus provides a mount of the hose within the intake compartment.

According to an aspect there is provided a water intake system as described above, wherein the open pipe section is configured with an aperture for connecting an interior volume of the water lift hose with an interior volume of the intake compartment.

Thus the open pipe section provides that water can flow from the interior of the hose into the interior of the intake compartment.

According to an aspect there is provided a water intake system as described above, wherein the open pipe section comprises an upper connector part for connection to a portion of the water lift hose above the intake compartment and a lower connector part for connection to a part of the water lift hose extending below the intake compartment, and the inlet is arranged with a seal for sealing the water lift hose at the lower connector part of the open pipe section.

In this manner the open pipe section positions the water lift hose relative to the intake compartment. By means of the seal, it is prevented that marine growth (aquatic life) develops at the inlet of the intake compartment, providing that the inlet can remain open for water flow.

According to an aspect there is provided a water intake system as described above, wherein the water lift hose is arranged as a string of a plurality of disconnectable hose sections.

By sectioning the water lift hose the (de)installation of the water lift hose in the system is facilitated. The water lift hose can be altered (extended/shortened) by adding or removing hose sections from the string.

According to an aspect there is provided a water intake system as described above, wherein an external length of the water lift hose extending below the hull is configured as function of the operation mode of the vessel.

Depending on the conditions at the operation site, the desired depth of the intake point of the water lift hose can be chosen by adapting the length of the water lift hose (by selecting the required number of hose sections in the string).

According to an aspect there is provided a water intake system as described above, wherein in a first operation mode the water lift hose virtually does not extend from the hull, and in a second operation mode the water lift hose extends below the hull of the vessel.

During a first operational mode, i.e., sailing mode, the depth of the intake point may be small. For example, only a strainer at the end of the water lift hose extends outside of the hull. The length of a strainer is about 1 m or less. According to an embodiment, in first operational mode (sailing mode) the external length is 1 m or less.

In practice during a second operational mode, i.e., moored operation of the vessel, the depth of the intake point below the vessel can be 20 m or more, for example between about 20 m and about 400 m. According to an embodiment, in second operational mode (moored operation), the water lift hose extends about 20 m or more below the hull.

According to an aspect there is provided a water intake system as described above, wherein the higher level of the vessel is arranged with handling facilities to add or to remove hose sections from the string of hose sections of the water lift hose.

The water lift hose may for example be a tube, a bonded or unbonded hose or a composite pipe.

In an embodiment, the higher level of the vessel is a top or main deck. The handling facilities allow that hose sections are added or removed from the string of sections that form the water lift hose. Once one hose section is lifted above the vessel main deck, a holding clamp is actuated to temporarily hold the remaining hose part while the flange connection is unbolted and the disconnected hose section can be transported to its storage location. Next, the holding clamp hands over to the crane or lifting facility and previous steps are repeated until the full string is retracted, disassembled and stored. Clearly the handling facility can also add hose sections to the water lift hose in a reversed operation.

According to an aspect there is provided a water intake system as described above, wherein the system comprises a lifting device at the higher level of the vessel for vertically moving the water lift hose.

Such a handling facility may comprise either a topsides crane or a dedicated lifting facility.

According to an aspect there is provided a water intake system as described above, wherein the floating vessel is a floating production unit for hydrocarbons such as an FLNG or FPSO. Also the floating vessel may be a semi-submersible vessel.

According to an aspect there is provided a water intake system as described above, wherein a water transporting conduit is arranged between the intake compartment and the distribution compartment and a valve is arranged in the conduit between the intake compartment and the distribution compartment for opening or closing the conduit.

This allows to isolate either compartment from the other compartment and to provide maintenance services.

According to an aspect there is provided a water intake system as described above, wherein at least one of the intake compartment and the distribution compartment is configured to be drained when sealed from the body of water.

By draining the respective compartment inspection of the compartment can be done from the interior of the vessel without interaction by a diver.

According to an aspect there is provided a water intake system as described above, wherein the water intake system is arranged in a sponson that is attached to a side of the vessel and that extends the hull of the vessel.

According to an aspect there is provided a water intake system as described above, wherein the intake compartment of the water intake system is within the sponson, and the inlet is positioned in a bottom region of the sponson.

According to an aspect there is provided a floating vessel selected from a group comprising FPSO and FLNG production units, comprising a water intake system as described above. In an embodiment, the floating vessel may be a semi-submersible vessel.

According to an aspect there is provided a floating vessel as described above, wherein the floating vessel comprises at least one sponson that is attached or constructed to a side of the vessel, and the water intake system is arranged within a volume of the sponson.

BRIEF DESCRIPTION OF DRAWINGS

The invention will be explained in more detail below with reference to drawings in which illustrative non-limiting examples of embodiments of the invention are shown. It will be appreciated by the person skilled in the art that other alternative and equivalent embodiments of the invention can be conceived and reduced to practice without departing from the spirit of the invention. It is intended that the invention be construed as including all such alternatives and equivalents insofar as they come within the scope of the appended claims.

DETAILED DESCRIPTION OF EMBODIMENTS

Figure 1:
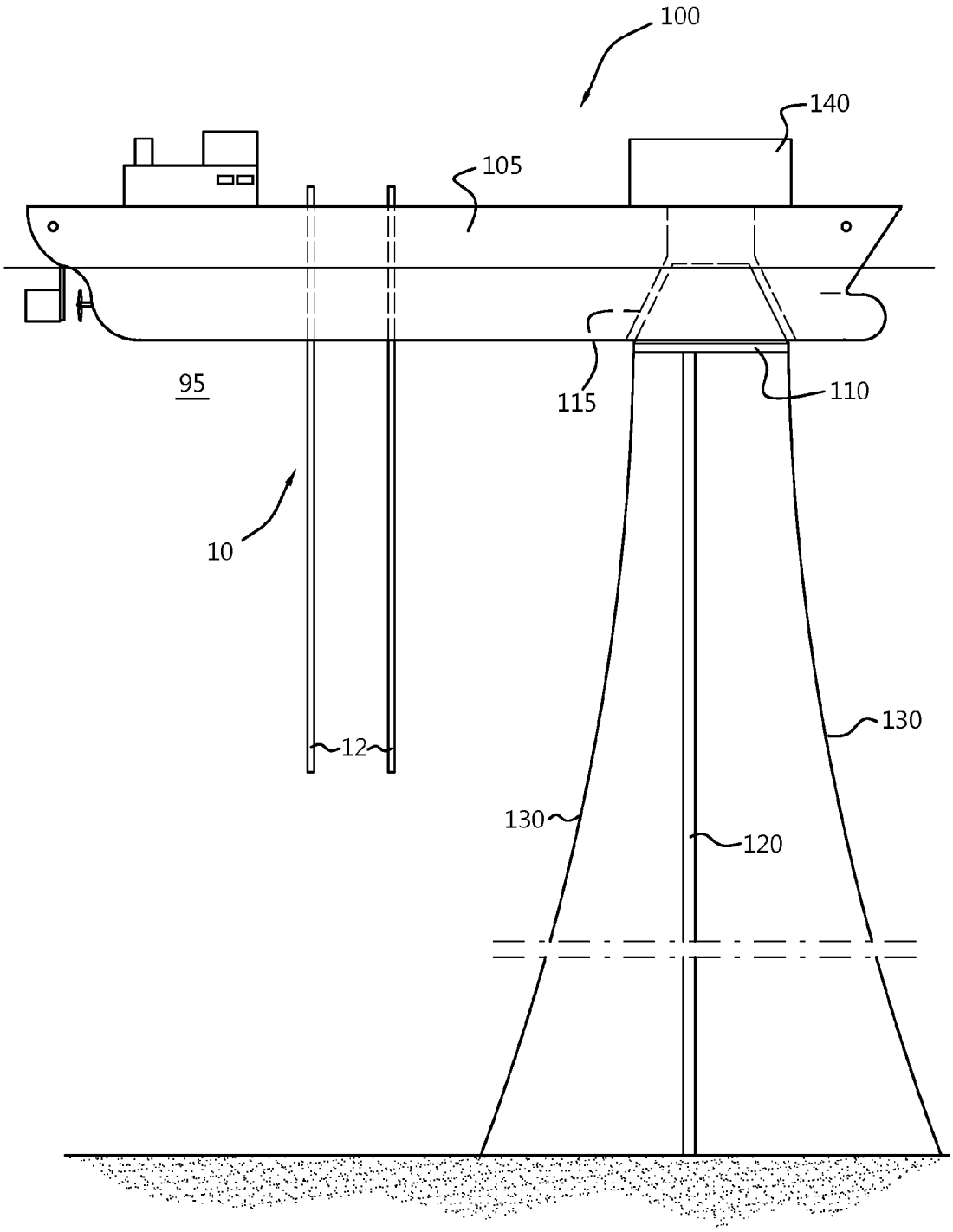
FIG. 1 shows schematically a floating vessel provided with a water intake system in accordance with an embodiment of the invention.

FIG. 1 shows schematically a floating vessel provided with a water intake system in accordance with an embodiment of the invention.

The floating vessel 100 is arranged for storage and/or production of hydro-carbon fluids, from undersea gas or oil fields.

Such a floating vessel can be a floating storage and offloading (FSO) or a floating production, storage and offloading (FPSO) vessel. In an embodiment, such a vessel may be a semi-submersible vessel.

At its operational position on the water 95 the floating vessel 100 is secured by a disconnectable turret mooring system comprising a mooring buoy 110 and a turret mooring structure 115 (or alternatively the vessel can be secured in a spread moored arrangement by a set of mooring lines (not shown)).

The mooring buoy 110 is anchored to the seabed with anchoring legs 130. The turret mooring structure 115, provided on the floating vessel 100, has a receptacle for receiving the buoy and one or more buoy locking devices for locking the buoy in the receptacle.

As shown in this figure the turret mooring structure 115 is an internal turret mooring structure (but alternatively may be an external turret mooring structure).

When the floating vessel 100 is in operation, processing equipment 140 on the floating vessel produces hydro-carbon fluids from sources as undersea gas or oil fields. Risers 120 provide a conduit for the feed material to the processing equipment 140. During this operation the processing equipment 140 uses seawater for auxiliary purposes such as cooling. The floating vessel 100 is equipped with a water intake system 10 in accordance with the present invention. From the bottom of the hull 105 of the vessel one or more water lift hoses 12 extend into the depth. The water lift hose(s) is connected to an intake compartment (not shown) within the hull 105. Forced by gravity water flows into the intake compartment. From the intake compartment the water will be distributed to consumer units such as the processing equipment 140. This will be explained in more detail with reference to FIGS. 2-4.

The length of the water lift hose(s) depends on the operational mode of the floating vessel 100. During production of hydro-carbon fluids the water lift hose is typically extended to a depth where supply conditions are desirable: for example, the water has a preferred temperature for cooling and/or the water has a reduced aquatic life to prevent marine growth within the water intake system. In sailing mode, the water lift hose is usually shortened to avoid damage to the water lift hose and/or reduce drag of the vessel.

Figure 2:
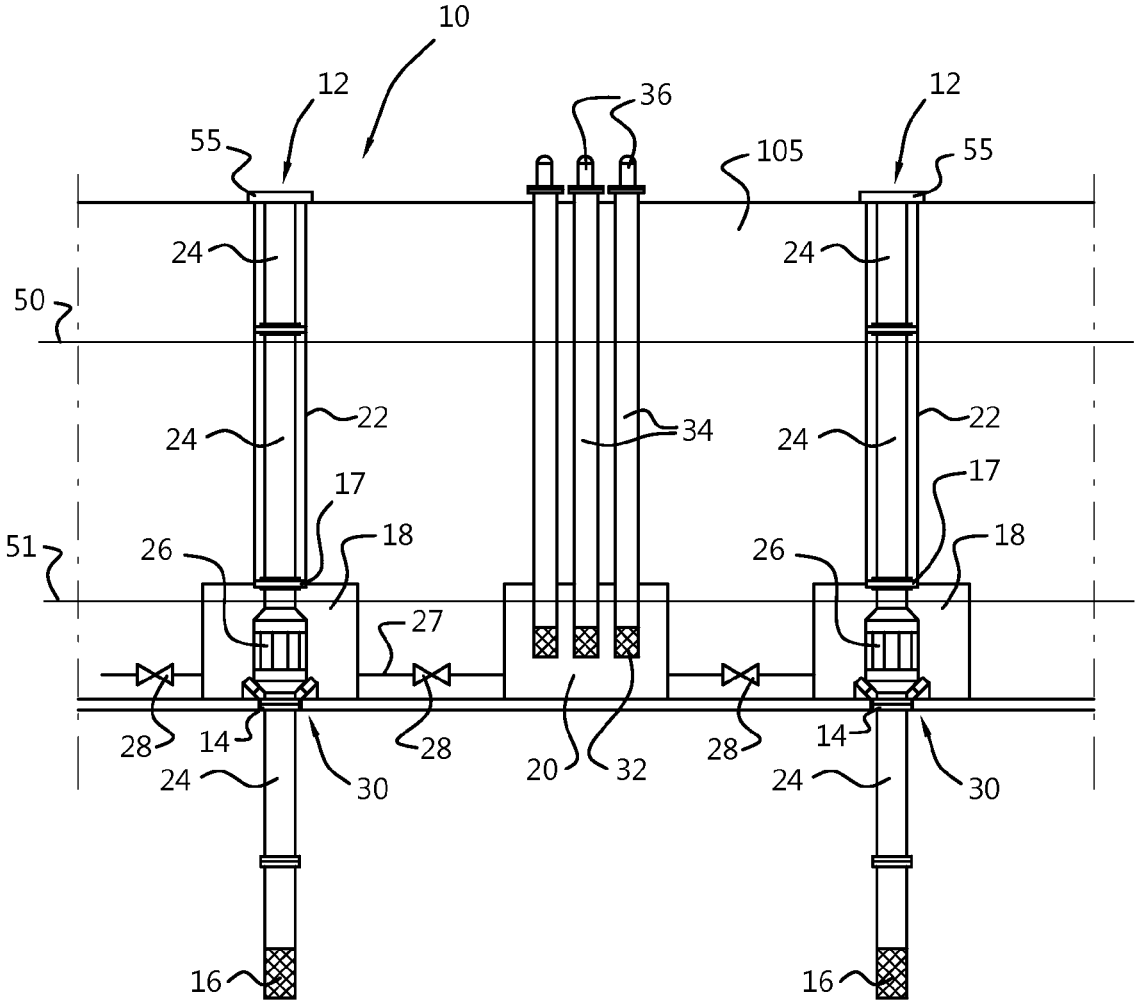
FIG. 2 shows a detailed schematic view of the water intake system according to an embodiment.

FIG. 2 shows a detailed schematic side view of the water intake system according to an embodiment.

As shown in this schematic view of the side of the hull 105 of the vessel, the water intake system 10 according to an embodiment comprises at least one intake compartment 18 and a distribution compartment 20.

The intake compartment 18 is closed volume for holding water, and has an inlet 14 in a bottom region of the hull 105. The water intake system further comprises at least one water lift hose 12 that is coupled to the intake compartment 18 and extends from the bottom of the hull through the inlet 14 into the depth of the sea.

A minimum draught of the vessel is schematically indicated by a lower horizontal line 51, a maximum draught under normal operation is schematically indicated by an upper horizontal line 50.

The water lift hose 12 is suspended from a higher level of the vessel (e.g., the top deck) above the intake compartment 18 and enters the intake compartment 18 through a top opening 17 in the compartment 18. The water lift hose is guided through a caisson 22 that extends between the higher level of the vessel and the top opening 17 of the intake compartment 18. The caisson 22 is sealed to the intake compartment at the top opening 17. On the higher level deck the water lift hose(s) is closed with a cover 55.

The water lift hose 12 is constructed from a plurality of hose sections 24, which allows to change the length of the water lift hose by adding or removing one or more hose sections 24.

Inside the intake compartment 18 between the inlet 14 and the top opening 17, the water lift hose 12 comprises an open pipe section 26, which is arranged with an aperture that provides an opening between the interior volume of the water lift hose 12 and the interior of the intake compartment 18. In this manner an open connection between the seawater and the water in the intake compartment is provided.

The inlet of the intake compartment 18 is provided with a seal 30 that is configured to close the periphery between inlet and the water lift hose. In this manner, water leakage and entry of objects such as aquatic life into the intake compartment is avoided. Advantageously this prevents that marine growth in the inlet can block inflow of water into the intake compartment.

In an embodiment, the open pipe section comprises an upper connector part for connection to a portion of the water lift hose above the intake compartment and a lower connector part for connection to a part of the water lift hose extending below the intake compartment, and the seal is configured between the inlet and a lower part of the open pipe section.

Below the hull, the distal end of the water lift hose 12 is provided with a strainer 16 that also blocks inflow of objects.

The intake compartment is connected with the distribution compartment 20 by means of a conduit 27 in a manner that water can flow from the intake compartment 18 to the distribution compartment 20. Preferably, the conduit 27 can be closed by a valve 28.

The distribution compartment 20 is configured as a buffer tank from which water can be distributed to processing equipment 140 through one or more distribution lines 34. Each distribution line 34 is provided by a pump 32, for example a caisson pump, that feeds the water to the topside location 36 of the processing equipment 140.

Figure 3:
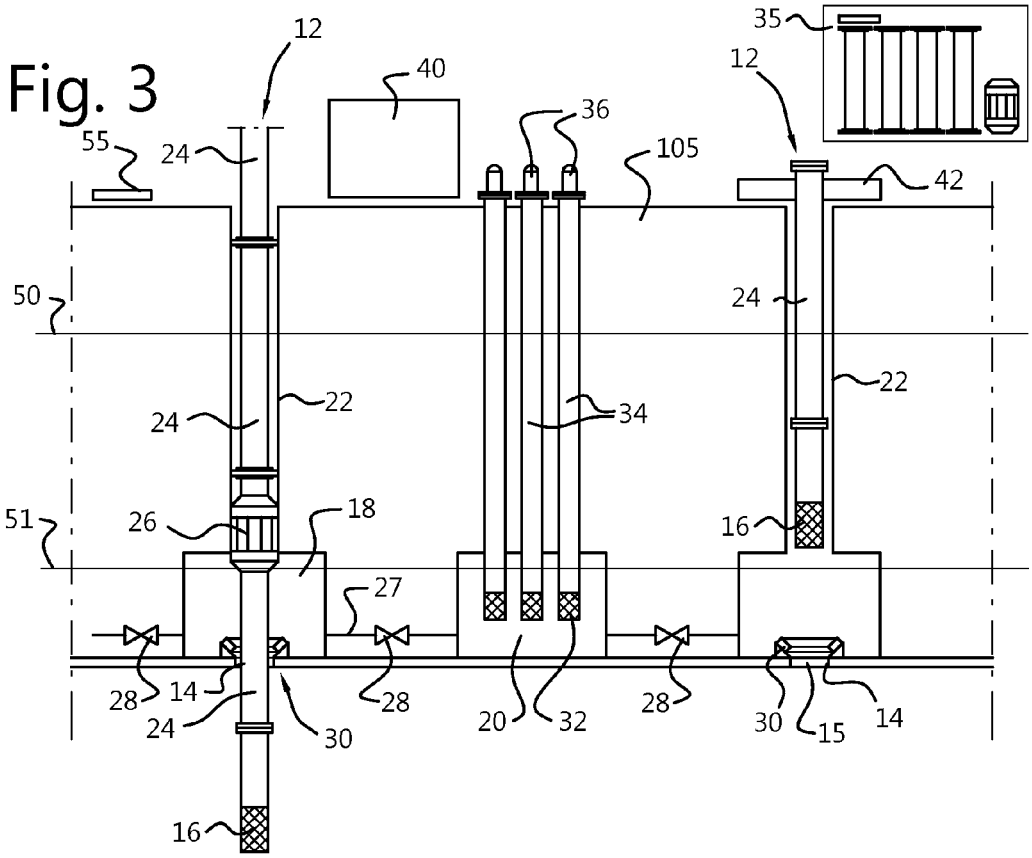
FIG. 3 shows a detailed schematic view of the water intake system according to an embodiment.

FIG. 3 shows a detailed schematic side view of the water intake system according to an embodiment.

Due to the construction of the water lift hose 12 by a string of hose sections 24 linked to each other, the water lift hose 12 can be assembled/disassembled to adapt the length of the water lift hose below the hull of the vessel. To this end the water intake system according to an embodiment is provided with a mechanical handling system 40 (schematically shown as box 40) that is configured to add or remove hose sections 24 from the string that forms the water lift hose 12. Individual hose sections 24 can be stored in a storage area 35 preferably on the deck.

As illustrated in FIG. 3, the water lift hose can be retracted inside the intake compartment 18. A clamp 42 can be provided to secure the water lift hose in retracted position. In an embodiment, the inlet 14 is provided with a hatch 15 that can close the inlet and separate the intake compartment from the sea.

Moreover, by the valve 28 in the conduit 27 between the intake compartment 18 and the distribution compartment 20, each of the intake compartment and the distribution compartment can be isolated and drained.

Advantageously, when the compartment has been drained, inspection of the interior of the compartment(s) 18, 20 can take place without interference by one or more divers. In this manner, safety of operation is improved.

Figure 4:
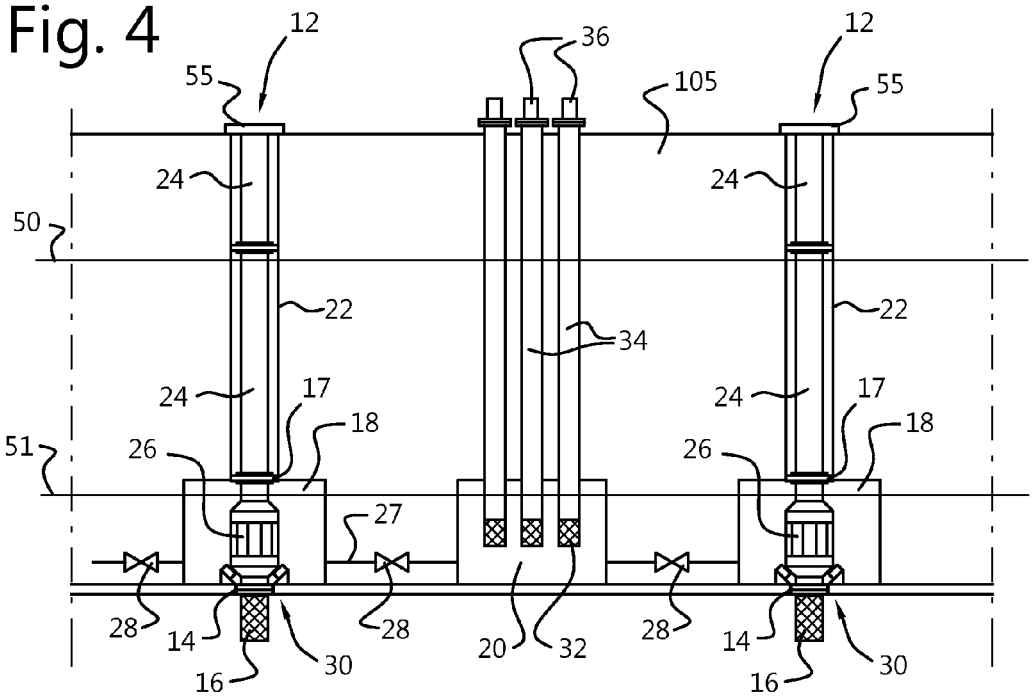
FIG. 4 shows a detailed schematic view of the water intake system according to an embodiment.

FIG. 4 shows a detailed schematic side view of the water intake system according to an embodiment.

In FIG. 4, the water lift hose(s) 12 of the water intake system 10 are in retracted position with only the strainers 16 extending from the hull 105. In this configuration, the vessel can be sailing while at the same time the water intake system is arranged for intake of sea water at the surface level.

Figure 5:
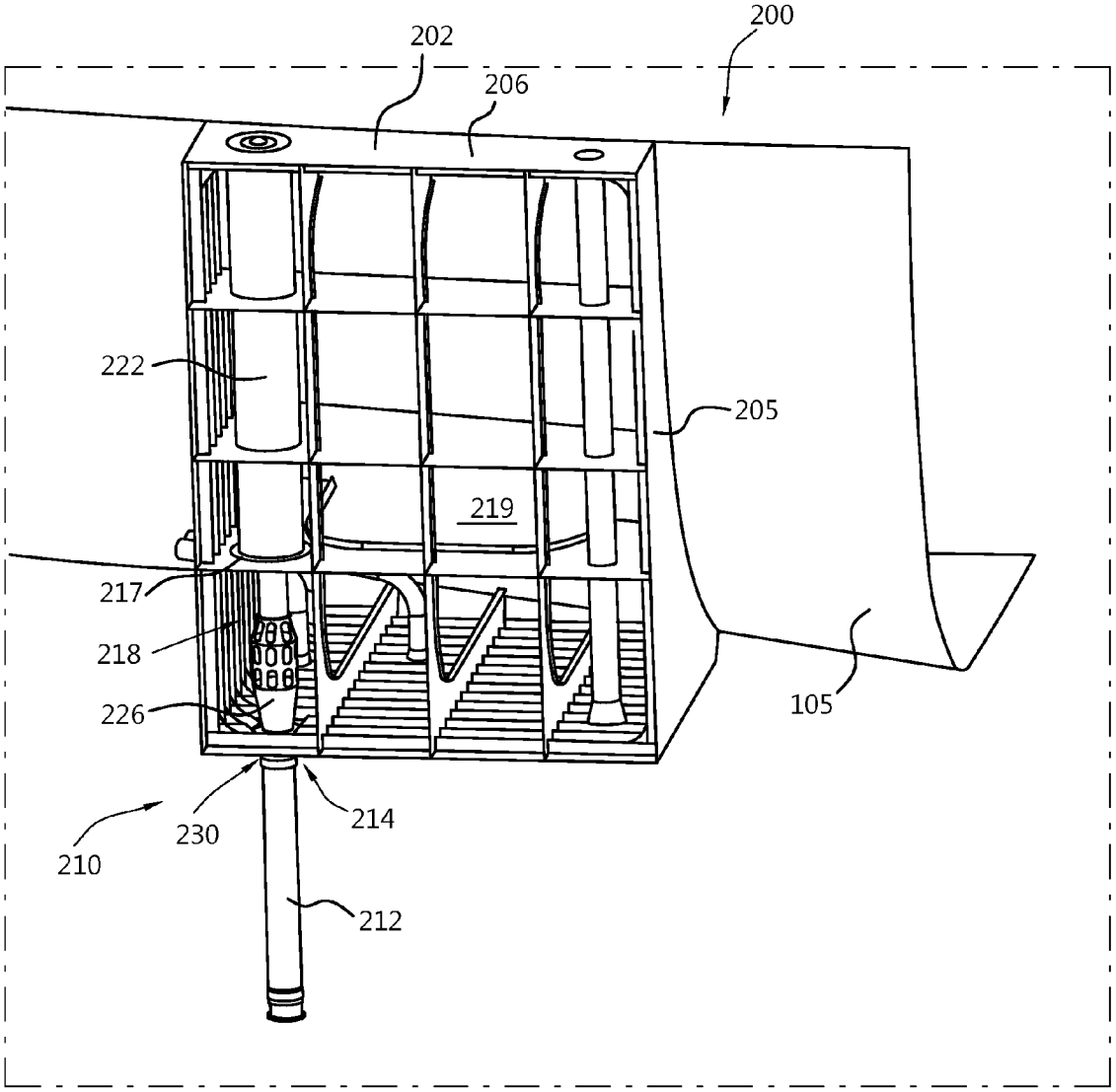
FIG. 5 shows an exploded perspective view of a vessel with an water intake system according to an embodiment of the invention.

FIG. 5 shows an exploded perspective view of a section of a vessel 200 with an water intake system 210 according to an embodiment of the invention.

The vessel 200 is provided with one or more sponsons 202 on either starboard or larboard side or on both starboard and larboard sides.

The sponson 202 is a dry volume attached or constructed to a side of the vessel which extends the hull and/or the volume of the vessel. Typically, the sponson is a box-like construction, but may be streamlined to reduce drag during voyage of the vessel.

According to this embodiment, the volume in hull 105 of the vessel comprises a volume part 205 located in the sponson (also referred to as sponson part of the hull). The hull is arranged to accommodate in the volume part 205 of the sponson, a water intake system 210 as described above in more detail.

Thus, the vessel is equipped with one or more sponsons and the hull of the vessel additionally includes the volume of the one or more sponsons.

As shown in this exploded perspective view of the side of the sponson part 205 of the hull of the vessel, a water intake system 210 according to an embodiment of the invention is arranged in the sponson part of the vessel and comprises at least one intake compartment 218.

The intake compartment 218 is a closed volume for holding water within the sponson 202, and has an inlet 214 in a bottom region of the sponson part of the hull 205. The water intake system 210 further comprises at least one water lift hose 212 that is coupled to the intake compartment 218 and extends from the bottom region of the sponson part of the hull through the inlet 214 into the depth of the sea.

The water lift hose 212 is suspended from a higher level of the sponson (e.g., a top deck 206 of the sponson) above the intake compartment 218 and enters the intake compartment 218 through a top opening 217 in the compartment 218. The water lift hose is guided through a caisson 222 that extends between the higher level of the sponson and the top opening 217 of the intake compartment 218. The caisson 222 is sealed to the intake compartment at the top opening 217.

As in the other embodiments, inside the intake compartment 218 between the inlet 214 and the top opening 217, the water lift hose 212 comprises an open pipe section 226, which is a tubular section arranged with an aperture that provides a passage between the interior volume of the water lift hose 212 and the interior volume of the intake compartment 218. In this manner an open connection between the seawater and the water in the intake compartment is provided.

The open pipe section 226 is designed such that it is structurally sound, has an aperture comprising a number of openings in it periphery. The openings are designed as large as possible, such that the pressure drop through the open pipe section is minimal, but the mechanical strength and stability remain adequate.

The inlet 214 of the intake compartment 218 is provided with a seal 230 that is configured to close the periphery between the inlet and the water lift hose. In this manner, water leakage and entry of objects such as aquatic life into the intake compartment is avoided. Advantageously this prevents that marine growth in the inlet can block inflow of water into the intake compartment.

The intake compartment 218 may be connected with a distribution compartment (not shown) within the sponson 202, or alternatively be directly connected (not shown) to water demanding systems and appliances on the vessel, such as processing equipment. Other water consumers may comprise engine room consumers, ballast pumps, topsides seawater lift pumps, fire water pumps.

With reference to FIG. 3, it is noted that the water lift hose 212 is preferably constructed by a string of hose sections 24 linked to each other, in such a way that the water lift hose 212 can be assembled/disassembled to adapt the length of the water lift hose 212 below the sponson part 205 of the hull of the vessel. In the embodiment shown in FIG. 5, the water intake system 210 is likewise provided with a mechanical handling system (not shown) that is configured to add or remove hose sections from the string that forms the water lift hose 212.

In an embodiment, the inlet 214 is provided with a hatch 215 that can close the inlet 214 and separate the intake compartment 218 from the seawater.

The foregoing descriptions of embodiments of the present invention have been presented for purposes of illustration and description only. They are not intended to be exhaustive or to limit the present invention to the disclosed embodiments. Other alternatives and equivalent embodiments of the present invention are conceivable within the idea of the invention, as will be clear to the person skilled in the art. The scope of the invention is limited only by the appended claims.

The invention claimed is:

1. A water intake system for a floating vessel in a body of water, the water intake system comprising within the hull of the vessel:

an intake compartment for taking in water from the body of water and a distribution compartment for distributing and supplying the water to one or more consumer units within the floating vessel;

the intake compartment being arranged below a lowest operational draught of the vessel and having an inlet in a bottom region of the intake compartment, the intake compartment being in fluid communication with the distribution compartment for allowing water to flow into the distribution compartment;

the water intake system further comprising a water lift hose that is connected to the inlet and is extendible below the hull of the vessel, wherein the water lift hose is suspended from a higher level of the vessel above the intake compartment through an internal opening in a top region of the intake compartment, wherein the water lift hose comprises an open pipe section located in between the inlet and the internal opening of the intake compartment, and wherein the open pipe section comprises an upper connector part for connection to a portion of the water lift hose above the intake compartment and a lower connector part for connection to a part of the water lift hose extending below the intake compartment, and the inlet is arranged with a seal for sealing the water lift hose at the lower connector part of the open pipe section.

2. The water intake system according to claim 1, wherein the inlet is arranged in a substantially horizontal plane in the hull and the water lift hose extends vertically from the hull.

3. The water intake system according to claim 1, wherein the water lift hose is guided through a caisson between the higher level of the vessel and the internal opening of the intake compartment.

4. The water intake system according to claim 1, wherein the open pipe section is configured with an aperture for connecting an interior volume of the water lift hose with an interior volume of the intake compartment.

5. The water intake system according to claim 1, wherein the water lift hose is arranged as a string of a plurality of disconnectable hose sections.

6. The water intake system according to claim 5, wherein the higher level of the vessel is arranged with handling facilities to add or to remove hose sections from the string of hose sections of the water lift hose.

7. The water intake system according to claim 1 wherein an external length of the water lift hose extending below the hull is configured as function of the operation mode of the vessel.

8. The water intake system according to claim 7, wherein in a first operation mode the water lift hose is in retracted position with only strainers extending from the hull, and in a second operation mode the water lift hose extends below the hull of the vessel.

9. The water intake system according to claim 1, wherein the water intake system comprises a lifting device at the higher level of the vessel for vertically moving the water lift hose.

10. The water intake system according to claim 1, wherein a water transporting conduit is arranged between the intake compartment and the distribution compartment and a valve is arranged in the conduit between the intake compartment and the distribution compartment for opening or closing the conduit.

11. The water intake system according to claim 1, wherein at least one of the intake compartment and the distribution compartment is configured to be drained when sealed from the body of water.

12. The water intake system according to claim 1, wherein the water intake system is arranged in a sponson that is attached to a side of the vessel and that extends the hull of the vessel.

13. The water intake system according to claim 12, wherein the intake compartment of the water intake system is within the sponson, and the inlet is positioned in a bottom region of the sponson.

14. A floating vessel selected from a group comprising a floating production and storage (FPSO) production unit and a floating liquid natural gas (FLNG) production unit, comprising a water intake system according to claim 1.

15. The floating vessel according to claim 14, wherein the floating vessel comprises at least one sponson that is attached or constructed to a side of the vessel, and the water intake system is arranged within a volume of the sponson.

* * * * *